US009085440B2

(12) United States Patent
Choi

(10) Patent No.: US 9,085,440 B2
(45) Date of Patent: Jul. 21, 2015

(54) ELECTRONIC HYDRAULIC PRESSURE CONTROL APPARATUS AND METHOD USING VARIABLE BEHAVIOR

(75) Inventor: Ki Hong Choi, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 346 days.

(21) Appl. No.: 13/517,500

(22) PCT Filed: Dec. 21, 2010

(86) PCT No.: PCT/KR2010/009160

§ 371 (c)(1),
(2), (4) Date: Sep. 12, 2012

(87) PCT Pub. No.: WO2011/078557

PCT Pub. Date: Jun. 30, 2011

(65) Prior Publication Data

US 2013/0001449 A1 Jan. 3, 2013

(30) Foreign Application Priority Data

Dec. 22, 2009 (KR) ..... 10-2009-0128615

(51) Int. Cl.
*B66C 13/56* (2006.01)
*E02F 9/22* (2006.01)

(52) U.S. Cl.
CPC ..... *B66C 13/56* (2013.01); *E02F 9/2203* (2013.01); *F15B 2211/6346* (2013.01); *F15B 2211/7733* (2013.01)

(58) Field of Classification Search
CPC ..... E02F 9/221; E02F 9/2203; E02F 3/405; F15B 2211/6346; F15B 2211/7733; B66C 13/56
USPC ..... 137/596.16; 251/129.04, 129.08; 91/7, 91/248, 275, 459, 37, 435; 60/327, 445; 700/75, 172, 257; 318/592
See application file for complete search history.

(56) References Cited

U.S. PATENT DOCUMENTS 5,235,809 A * 8/1993 Farrell ..... 60/445
5,287,885 A * 2/1994 Smith ..... 137/596.17

(Continued)

FOREIGN PATENT DOCUMENTS

JP 2002-286001 A 10/2002
JP 2005-273442 A 10/2005

(Continued)

OTHER PUBLICATIONS

Search Report dated Sep. 29, 2011 written in Korean for International application No. PCT/KR2010/009160, filed Dec. 21, 2010, 3 pages.

(Continued)

*Primary Examiner* — Matthew W Jellett
(74) *Attorney, Agent, or Firm* — John D. Veldhuis-Kroeze; Westman, Champlin & Koehler, P.A.

(57) ABSTRACT

The present disclosure relates to an electronic hydraulic pressure control apparatus and an electronic hydraulic pressure control method using a variable behavior, and more particularly, to an electronic hydraulic pressure control apparatus and an electronic hydraulic pressure control method using a variable behavior which can detect that a user manipulates an electronic joystick of an electronic hydraulic system to positive and negative positions with respect to a neutral point in a preset time period, and vary a behavior (for example, a general behavior or an abrupt operation behavior) according to the detection result, thereby enhancing both comfortableness of an operator and an abrupt operation efficiency in manipulating a construction machine and providing a convenience for an operator.

2 Claims, 5 Drawing Sheets

(56) References Cited

U.S. PATENT DOCUMENTS

| | | | | |
|---|---|---|---|---|
| 6,725,105 | B2 * | 4/2004 | Francis et al. | 700/75 |
| 6,763,661 | B2 * | 7/2004 | Tabor et al. | 60/327 |
| 7,269,943 | B2 * | 9/2007 | Buckmier et al. | 60/368 |
| 7,467,514 | B2 * | 12/2008 | Patel | 60/381 |
| 2002/0065575 | A1 | 5/2002 | Francis et al. | |
| 2005/0203691 | A1 * | 9/2005 | Kim | 701/50 |
| 2007/0039457 | A1 * | 2/2007 | Vigholm et al. | 91/459 |
| 2007/0172340 | A1 * | 7/2007 | Curotto et al. | 414/408 |
| 2009/0031891 | A1 * | 2/2009 | Brinkman et al. | 91/433 |
| 2009/0056322 | A1 * | 3/2009 | Brinkman et al. | 60/325 |

FOREIGN PATENT DOCUMENTS

| | | | |
|---|---|---|---|
| JP | 2006-322134 | A | 11/2006 |
| JP | 2008-215420 | A | 9/2008 |
| KR | 10-2006-0061997 | A | 6/2006 |
| WO | 2005100701 | | 10/2005 |

OTHER PUBLICATIONS

European Search Report dated Feb. 18, 2014 for European Patent Application No. 10839754.8, 6 pages.

* cited by examiner

ELECTRONIC HYDRAULIC PRESSURE CONTROL APPARATUS AND METHOD USING VARIABLE BEHAVIOR

This Application is a Section 371 National Stage Application of International Application No. PCT/KR2010/009160, filed Dec. 21, 2010 and published, not in English, as WO2011/078557 on Jun. 30, 2011.

FIELD OF THE DISCLOSURE

The present disclosure relates to an electronic hydraulic pressure control apparatus and an electronic hydraulic pressure control method using a variable behavior, and more particularly, to an electronic hydraulic pressure control apparatus and an electronic hydraulic pressure control method using a variable behavior which can detect that a user manipulates an electronic joystick of an electronic hydraulic system to positive and negative positions with respect to a neutral point in a preset time period, and vary a behavior (for example, a general behavior or an abrupt operation behavior) according to the detection result, thereby enhancing both comfortableness of an operator and an abrupt operation efficiency in manipulating a construction machine and providing a convenience for an operator.

BACKGROUND OF THE DISCLOSURE

According to the related art, a working tool of a construction machine is designed to be driven by a mechanical hydraulic system. Such a mechanical hydraulic system has a structure in which a main hydraulic pressure supplied to a hydraulic cylinder connected to a working tool of a construction machine is controlled by opening or closing a spool of a mechanical main control valve (MCV) with a pilot hydraulic pressure from a valve located at a joystick lever for controlling a pilot hydraulic pressure.

FIG. 1 is a diagram of a mechanical hydraulic system according to the related art.

As illustrated in FIG. 1, the mechanical hydraulic system according to the related art includes an engine 110, a pump 120, a hydraulic pressure valve 130 connected to a hydraulic joystick lever 131, a hydraulic main control valve 140 and a hydraulic cylinder 150. Here, the hydraulic main control valve 140 includes a spool 141 and is connected to the hydraulic cylinder 150 through an orifice 142.

The pump 120 operated by the engine 110 supplies a working fluid 121, that is, a hydraulic pressure to the hydraulic pressure valve 130 and the hydraulic main control valve (MCV) 140. The mechanical hydraulic system according to the related art is designed such that a working tool of a construction machine is driven by mechanically adjusting a hydraulic pressure.

A user manipulates the hydraulic joystick lever 131 to control the hydraulic cylinder 150. To this end, the hydraulic pressure valve 130 supplies a pilot hydraulic pressure supplied from the pump 120 to the hydraulic MCV 140 according to the manipulation of the hydraulic joystick lever 131 by the user. Then, the hydraulic pressure from the hydraulic pressure valve 130 is used to open or close the spool 141 of the mechanical MCV 140 and thus change a main hydraulic pressure supplied to the hydraulic cylinder 150 connected to the working tool.

Meanwhile, an operational behavior of the working tool against the hydraulic joystick lever 131 is determined according to characteristics of mechanical elements connected to the mechanical hydraulic system. For example, the behavior is determined according to a notch shape of the spool 141 in the hydraulic MCV 140 or characteristics of parts including an orifice 142 installed in a hydraulic pressure passage and the like. Such a part is a mechanical element and has fixed characteristics, and thus cannot have a variable structure to correspond to various behaviors during an operation thereof.

Thus, in the construction machine including such a mechanical hydraulic system according to the related art, a behavior of the hydraulic joystick lever 131 and the behavior of a working tool need to be determined by compromising a comfortableness of an operator and an abrupt operation (for example, a beating operation of a bucket) efficiency which are incompatible at a proper point. If the behavior is set too softly, considering a comfortableness of an operator, a beating operation may be problematic. The construction machine according to the related art employs a structure where a comfortableness of an operator is lowered to some degree and instead, a response of the hydraulic joystick lever 131 is increased to a proper point high enough not to cause a problem to an operation.

In particular, in a beating operation, a construction machine (for example, a wheel loader and an excavator) excavates an object having a certain degree of viscosity. For example, the viscous object to be excavated may include mud, livestock night soils, and concrete. In this case, an operation method for a construction machine for dropping residue stuck to a bucket due to viscosity by shaking the bucket upward and downward at a dumping place after an operator loads an object to be excavated in a bucket is necessary.

Here, the part shaking the bucket in the beating operation needs to be set to have a maximum value for changing a hydraulic pressure in order to show a maximum effect. That is, a structure for maximally increasing a response of the hydraulic joystick lever 131 may have an optimum operation efficiency in a beating operation. Meanwhile, if a response of the working tool is set only for a beating operation, vibrations are caused in the vehicle even in an operation other than the beating operation, hampering a comfortableness of the operator.

As described above, if a comfortableness of an operator is enhanced by making a behavior of a construction machine soft in the mechanical hydraulic system according to the related art, an efficiency of a specific operation, such as a load beating operation, which shows an abrupt response is lowered in response.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The present disclosure has been made in an effort to provide an electronic hydraulic pressure control apparatus and an electronic hydraulic pressure control method using a variable behavior which can enhance both comfortableness of a user and an abrupt operation efficiency in manipulating a construction machine, resulting in provision of a convenience for an operator.

In order to achieve the above object, the present disclosure provides an electronic hydraulic pressure control apparatus using a variable behavior, including: a signal input unit configured to receive a manipulation signal and a mode selection signal according to a manipulation of a user; a behavior mode changing unit configured to change a mode to a general behavior mode or an abrupt operation behavior mode according to the received mode selection signal; a signal processing unit configured to, according to the changed behavior mode, output the received manipulation signal in an one-to-one correspondence in the general behavior mode, and increase or decrease the received manipulation signal by a predetermined gain and output the increased or decreased manipulation signal in the abrupt operation behavior mode; and a proportional valve driving unit configured to drive a proportional valve according to a signal output by the signal processing unit.

The present disclosure detects that a user manipulates an electronic joystick of an electronic hydraulic system to positive and negative positions with respect to a neutral point in a preset time period and varies a behavior (for example, a general behavior or an abrupt operation behavior) according to the detection result, thereby enhancing both comfortableness of an operator and an abrupt operation efficiency in manipulating a construction machine and providing of a convenience for an operator.

DETAILED DESCRIPTION

Figure 1:
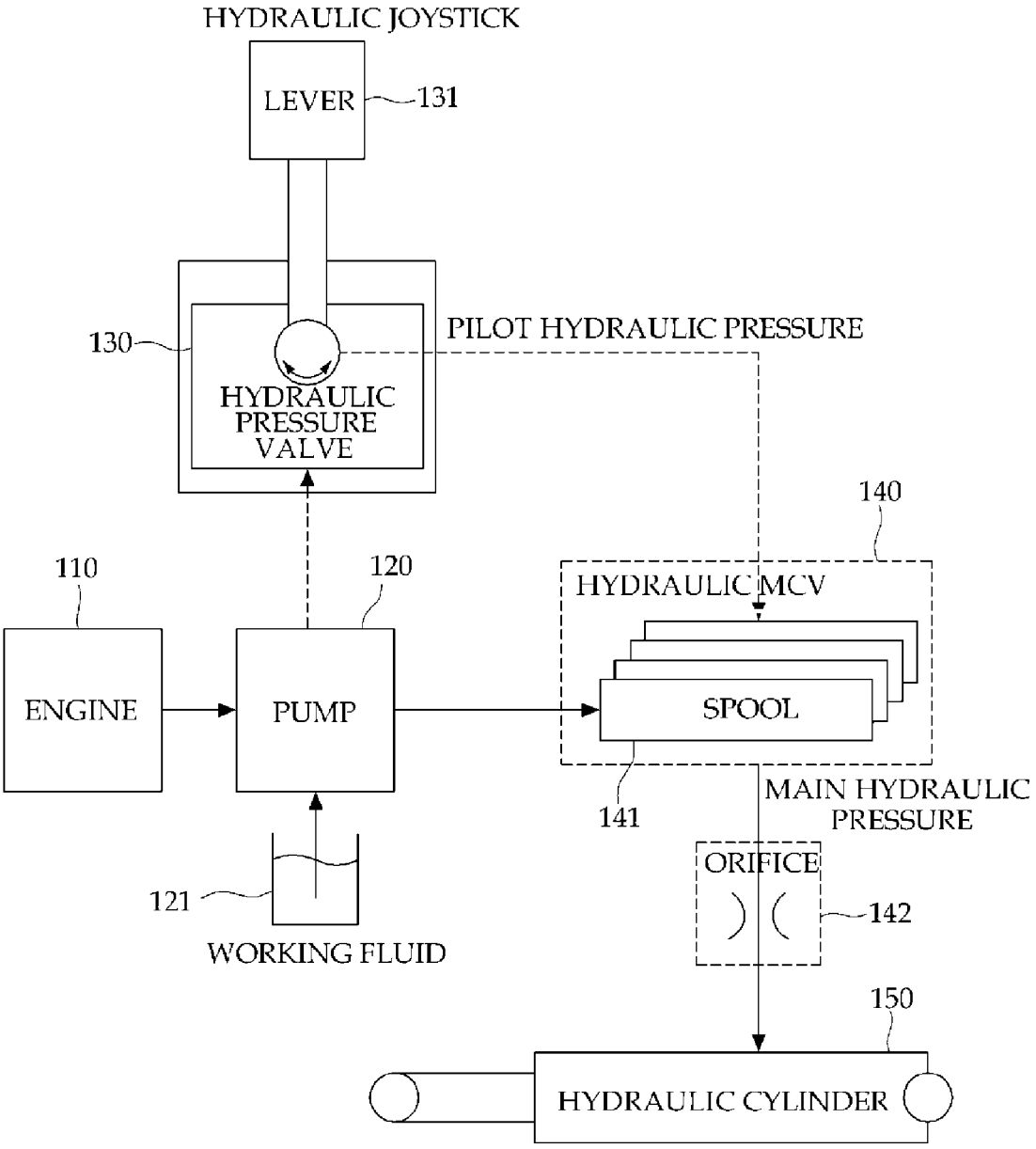
FIG. 1 is a diagram of a mechanical hydraulic system according to the related art.

Hereinafter, exemplary embodiments of the present disclosure will be described in detail with reference to the accompanying drawings. The configuration, operation, and effects of the present disclosure will be clearly understood through the following detailed description. Prior to the detailed description of the present disclosure, it is noted that the same elements are denoted by the same reference numerals even when represented in different drawings, and a detailed description of known configurations will be omitted when it is determined that the detailed description thereof makes the essence of the present disclosure obscure.

Figure 2:
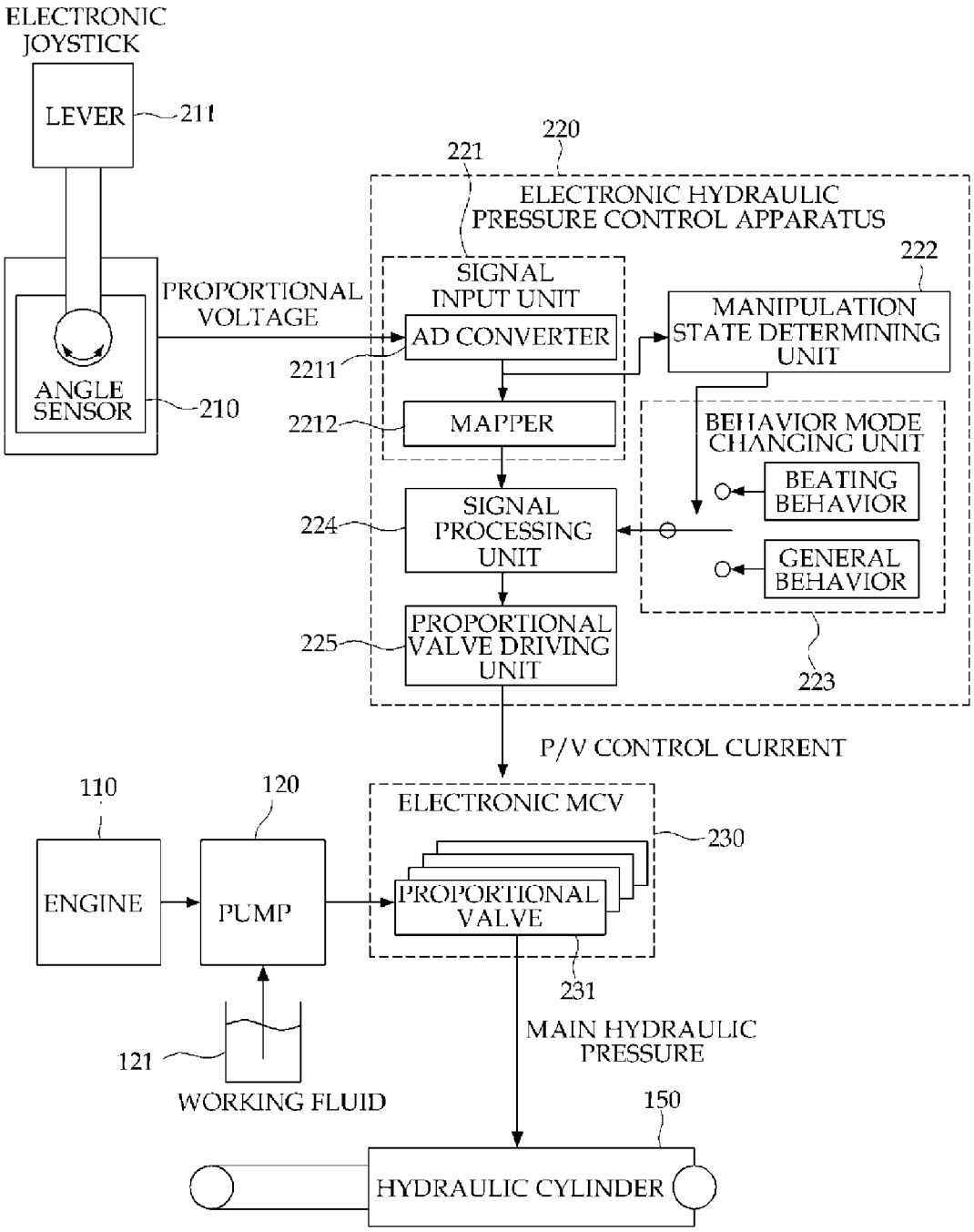
FIG. 2 is a diagram of an electronic hydraulic pressure control apparatus using a variable behavior according to an exemplary embodiment of the present disclosure.

FIG. 2 is a diagram of an electronic hydraulic pressure control apparatus using a variable behavior according to an exemplary embodiment of the present disclosure.

The electronic hydraulic pressure control apparatus 220 according to the present disclosure includes a signal input unit 221, a manipulation state determining unit 222, a behavior mode changing unit 223, a signal input unit 224 and a proportional valve driving unit 225. Here, the manipulation voltage input unit 221 includes an AD converter 2211 and a mapper 2212.

Hereinafter, constituent elements of the electronic hydraulic pressure control apparatus 220 according to the present disclosure will be described.

First, the electronic hydraulic pressure control apparatus 220 is connected to an angle sensor 210 connected to an electronic joystick lever 211. Here, the electronic joystick lever 211 is an example of a manipulator with which a user can manipulate a working tool, and the manipulator is not limited to a joystick.

The electronic hydraulic pressure control apparatus 220 is connected to an electronic main control valve 230 including a plurality of electronic proportional valves 231. The electronic main control valve 230 receives a working fluid (hydraulic pressure) from a pump 120 operated by an engine 110, and supplies a main hydraulic pressure to a hydraulic cylinder 150 according to a control current of the proportional valve 231 of the electronic hydraulic pressure control apparatus 220.

The signal input unit 221 receives a proportional voltage signal corresponding to a manipulation of the electronic joystick lever 211 by the user from the angle sensor 210, and performs an analog-digital conversion process and a mapping process on the input proportional voltage signal and outputs a digital manipulation signal of the joystick lever 211. The signal input unit 221 receives a mode selection signal (for example, a voice recognition signal, a switch signal and the like) related to a behavior mode of the working tool from the user. Here, the electronic hydraulic pressure control apparatus 220 may be connected to a voice recognizer and a switch (not illustrated in FIG. 2) to receive a mode selection signal of the user.

In detail, the AD converter 2211 of the signal input unit 221 receives a proportional voltage signal from the angle sensor 210 connected to the electronic joystick lever 211. The AD converter 2211 receives a mode selection signal from the voice recognizer, a switch or the like. Subsequently, the AD converter 2211 performs an analog-digital conversion on the input signal and outputs a digital signal. The output digital signal is transferred to the manipulation state determining unit 222 and the mapper 2212.

When the joystick lever 211 is located in a neutral position and a side position distant from the neutral position, the mapper 2212 maps the digital manipulation signal and outputs the mapped digital manipulation signal, considering operation characteristics of an operator.

Meanwhile, the manipulation state determining unit 222 analyzes the digital manipulation signal of the joystick lever 211 output by the signal input unit 221 and determines a manipulation state of the joystick lever 211 by the user. The manipulation state determining unit 222 may determine a mode selection signal to be for one of a general behavior mode and an abrupt operation behavior mode according to the determination result. The manipulation state determining unit 222 determines whether the digital manipulation signal corresponds to a general behavior mode or an abrupt operation (that is, a beating operation) behavior mode. In describing the abrupt operation mode, the operator repeatedly moves the joystick lever 211 for controlling a bucket to perform a beating operation in positive and negative positions with respect to a neutral position. Then, the manipulation state determining unit 222 detects an operation characteristic of the operator and determines that the operator performs a beating operation.

For example, if the position of the joystick lever 211 is changed from a positive position to a negative position, a positive position, and a negative position, or from a negative position to a positive position, a negative position, and a positive position with respect to the neutral position within one second, the manipulation state determining unit 222 detects a beating operation. Meanwhile, if the joystick continuously lies in a neutral position, a positive position, or a negative position within one second, the manipulation state determining unit 222 detects a general operation. Here, the general behavior mode refers to a general manipulation state where the user moves the joystick lever 211 in one direction with respect to the neutral position or does not abruptly move the joystick lever 211. Meanwhile, the abrupt operation (beating operation) behavior mode refers to a manipulation state where the user repeatedly moves the joystick lever 211 abruptly to positive and negative positions with respect to the neutral position for a specific time period.

The behavior mode changing unit 223 changes the behavior mode to the general behavior mode or the abrupt operation behavior mode according to the mode selection signal input by the signal input unit 221. The behavior mode changing unit 223 may change the behavior according to the behavior mode determined by the manipulation state determining unit 222. The behavior mode changing unit 223 changes the behavior to the beating behavior or the general behavior.

The signal processing unit 224 processes the digital manipulation signal output by the signal input unit 221 according to the behavior changed by the behavior mode changing unit 223. The signal processing unit 224 processes the digital manipulation signal to an integrated form in the general behavior. For example, the signal processing unit 224 increases or decreases the digital manipulation signal by a gain of the general behavior. Here, an increment of the gain means a delay in a speed of a reaction to the manipulation of the joystick lever 211.

The proportional valve driving unit 225 outputs a proportional valve (P/V) control current signal for controlling the proportional valve of the electronic main control valve (MCV) 230 according to a digital manipulation signal processed by the signal processing unit 224. Then, the proportional valve 231 of the electronic main control valve (MCV) 230 supplies a main hydraulic pressure to the hydraulic cylinder 150 according to the proportional valve control current signal.

Figure 3:
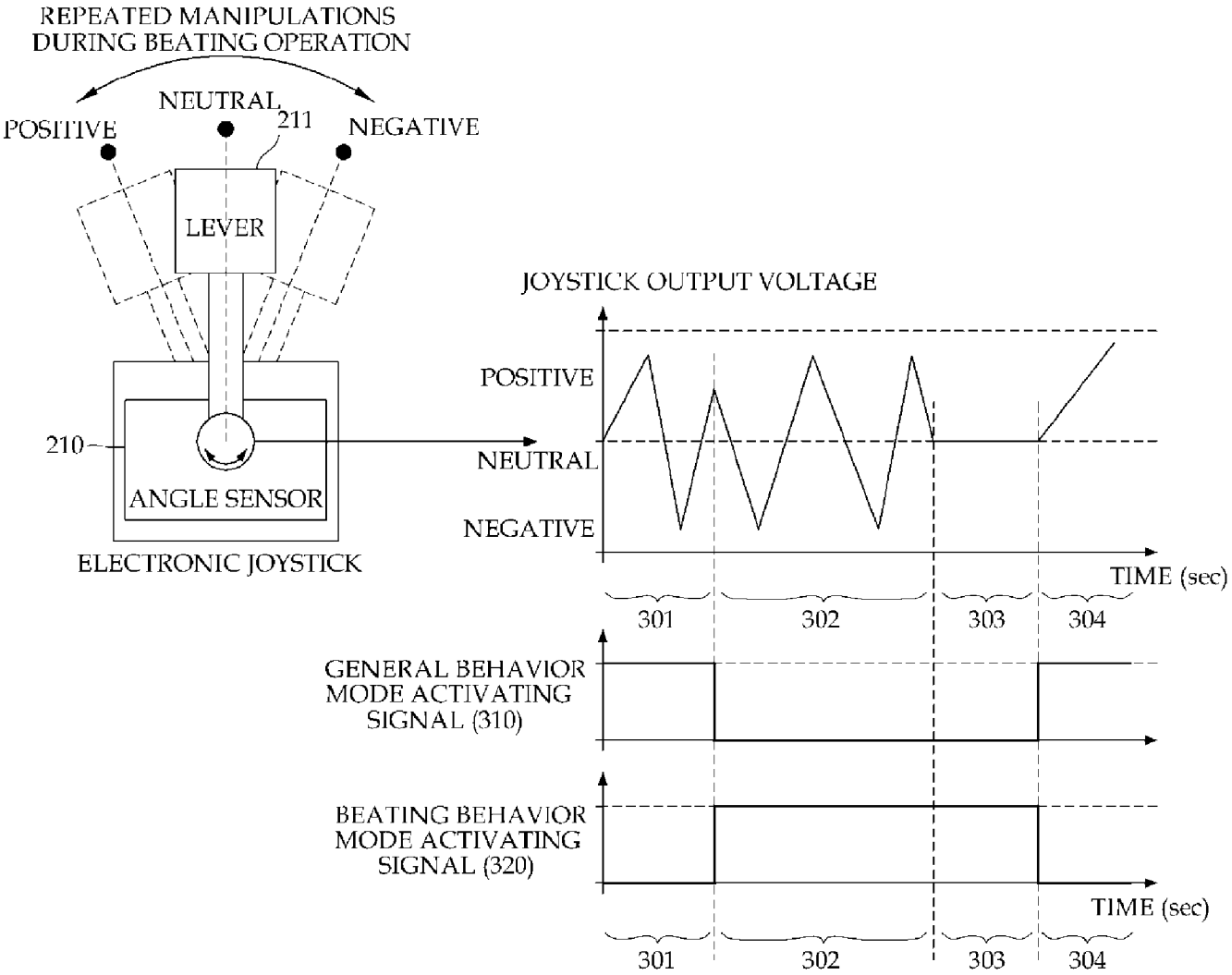
FIG. 3 is an explanatory view of a process of converting a behavior mode according to an output of a joystick according to an exemplary embodiment of the present disclosure.

FIG. 3 is an explanatory view of a process of converting a behavior mode according to an output of a joystick according to an exemplary embodiment of the present disclosure.

FIG. 3 illustrates a process of changing a general behavior mode to a beating behavior mode, and changing the beating behavior mode to a general behavior mode again. In the process, a general behavior mode is changed into a beating operation mode 302 through a repeated manipulation process 301 for a beating operation, and the beating behavior mode 302 is switched into a general operation mode 304 through a neutral manipulation process 303 for changing the beating behavior mode 302 to the general operation mode 304.

In describing the repeated manipulation process 301, the user repeatedly manipulates the electronic joystick lever 211 to positive and negative positions with respect to a neutral position. The angle sensor 210 outputs a joystick output voltage in the positive and negative positions according to the repeated manipulation of the joystick lever 211. Then, the manipulation state determining unit 222 determines the manipulation state to be a beating operation. In this case, a general behavior mode activating signal 310 represents an ON signal, and a beating behavior mode activating signal 320 represents an OFF signal. Here, it is assumed that the joystick lever 211 needs to be moved to positive and negative positions with respect to the neutral position at least three times for one second for a beating operation.

After step 301, the behavior mode changing unit 223 changes the behavior from a general behavior mode to a beating behavior mode 302. Here, the general behavior mode activating signal 310 represents an OFF signal, and the beating behavior mode activating signal 320 represents an ON signal. As the behavior is changed into the beating behavior in step 302, the operation is converted into an abrupt operation such that the beating operation can be easily performed.

In addition, if the joystick output voltage is maintained for one second or more without repeatedly moving to positive and negative positions with respect to a neutral position, the manipulation state determining unit 222 determines the manipulation state to be a general behavior operation. Here, the general behavior mode activating signal 310 represents an OFF signal, and the beating behavior mode activating signal 320 represents an ON signal.

After step 303, the behavior mode changing unit 223 changes the behavior from a beating behavior mode to a general behavior mode 304. Here, the general behavior mode activating signal 310 represents an ON signal, and the beating behavior mode activating signal 320 represents an OFF signal. In the general behavior mode 304, the electronic hydraulic pressure control apparatus 220 switches the behavior into a general behavior to process a signal.

Figure 4:
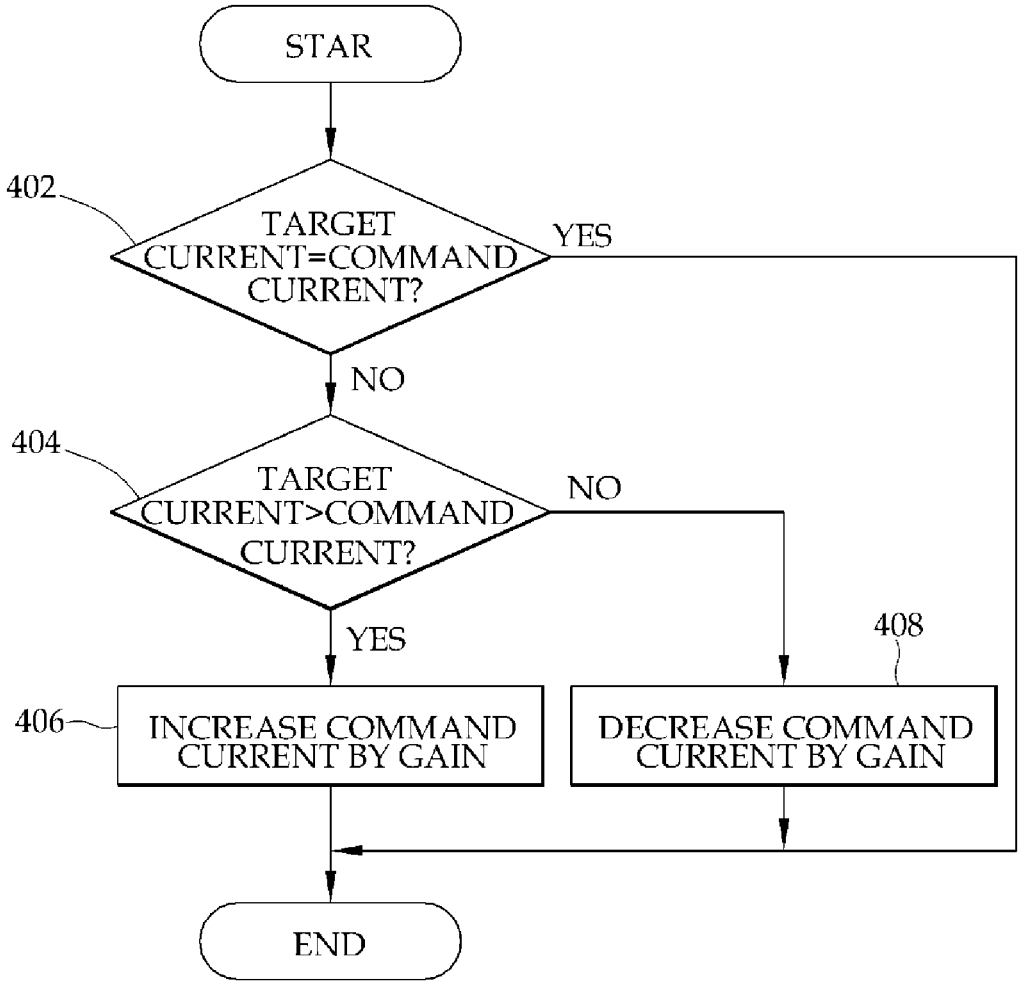
FIG. 4 is a flowchart of a method of processing a signal in a general behavior mode according to an exemplary embodiment of the present disclosure.

FIG. 4 is a flowchart of a method of processing a signal in a general behavior mode according to an exemplary embodiment of the present disclosure.

In the general behavior mode, the signal processing unit 224 receives a joystick output signal (hereinafter, referred to as a "target current") corresponding to a manipulation of the electronic joystick lever 211 from the mapper 221, and increases or decreases the received target current by a predetermined gain according to a general behavior to transfer the increased or decreased target current to the proportional valve driving unit 225. Hereinafter, a current value transferred to the proportional valve driving unit 225 by the signal processing unit 224 will be referred to as a command current.

The signal processing unit 224 checks whether or not the target current is the same as the command current (402).

If the checking result (402) shows that the target current is not the same as the command current, the signal processing unit 224 checks whether or not the target current exceeds the command current (404). Meanwhile, if the target current is the same as the command current, the signal processing unit 224 transfers the target current to the proportional valve driving unit 225 as it is.

If the checking result (404) shows that the target current exceeds the command current, the signal processing unit 224 increases the command current by a predetermined gain according to the general behavior and transfers the increased command current to the proportional valve driving unit 225 (406). Meanwhile, if the target current is not more than the command current, the signal processing unit 224 decreases the command current by a predetermined gain according to the general behavior and transfers the decreased command current to the proportional valve driving unit 225 (408). This is for setting a command current in an integrated form of a target current by a predetermined inclination, considering comfortableness of a user.

Figure 5:
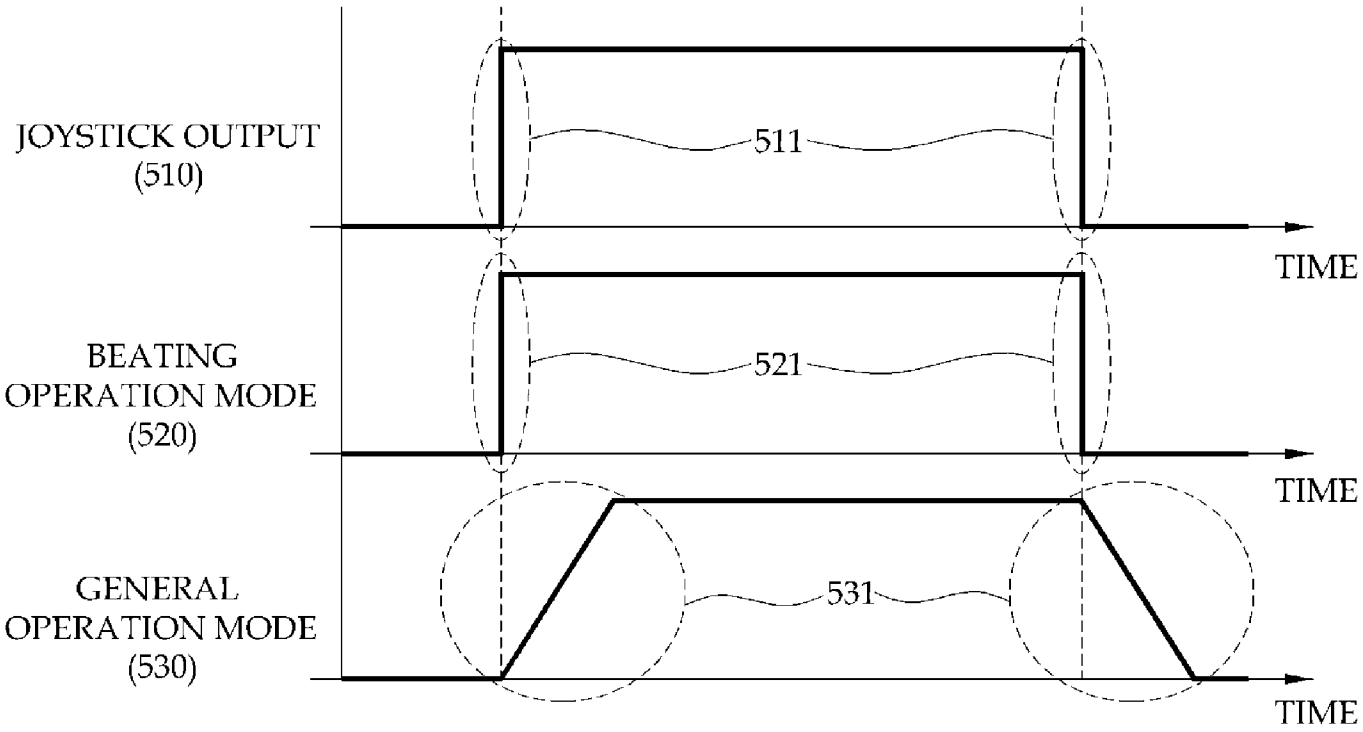
FIG. 5 is an explanatory view of a beating operation mode and a general operation mode in response to an output of a joystick according to an exemplary embodiment of the present disclosure.

FIG. 5 is an explanatory view of a beating operation mode and a general operation mode in response to an output of the joystick according to the present disclosure.

If the behavior mode is a beating behavior, the signal processing unit 224 transfers an output value of the joystick having undergone an analog-digital conversion process and a mapping process to the electronic proportional valve 231 as it is and controls the transferred output value. In this regard, an abrupt operation part 521 in the beating operation mode 520 corresponding to an abrupt operation part 511 of a joystick output value 510 will be described. If the joystick output value 510 is changed into a specific value at the abrupt operation part 511, the signal processing unit 224 outputs the joystick output value 510 as it is as illustrated in the beating operation mode 520.

Meanwhile, if the behavior mode is a general behavior, the signal processing unit 224 increases or decreases an output value of the joystick having undergone an analog-digital conversion process and a mapping process by a predetermined gain, and transfers the increased or decreased output value to the electronic proportional valve 231 to control the transferred output value. In this regard, an abrupt operation part 531 in a general operation mode 530 corresponding to an abrupt operation part 511 of the joystick output value 510 will be described. In the abrupt operation part 511 of the joystick output value 510, the joystick output value 510 is increased or decreased to a specific value by an inclination of the abrupt operation part 531 and is output.

Characteristics for behavior modes will be described with reference to Table 1 below.

TABLE 1

Characteristics for Behavior Modes

| Behavior Mode | Operation Method | Behavior Characteristic |
|---|---|---|
| Beating Behavior Mode | Controls an electronic proportional valve with an output value of a joystick having undergone an AD conversion process and a mapping process as it is. | It is easy to perform a beating operation since a construction machine shows a quick response according to a movement of a joystick. However, vibrations occur in the body of the construction machine. |
| General Behavior Mode | Controls such that an output value of a joystick having undergone an AD conversion process and a mapping process is increased or decreased by a predetermined gain in unit of time. | Vibrations of the body of a construction machine are reduced since the construction machine has a soft response (no abrupt operation) according to a movement of a joystick, but it is not easy to perform a specific operation such as a bucket beating operation. |

As described in Table 1, as the electronic hydraulic pressure control apparatus 220 controls an electronic proportional valve with an output value of a joystick having undergone an AD conversion process and a mapping process as it is in a beating behavior mode, it is easy to perform a beating operation since a construction machine shows a quick response according to a movement of a joystick. However, vibrations may occur in the body of the construction machine with a high possibility.

Meanwhile, as the electronic hydraulic pressure control apparatus 220 controls such that an output value of a joystick having undergone an AD conversion process and a mapping process is increased or decreased by a predetermined gain in unit of time in a general behavior mode, vibrations of the body of the construction machine are reduced since the construction machine has a soft response (no abrupt operation) according to a movement of a joystick, but it may not be easy to perform a specific operation such as a bucket beating operation.

Accordingly, the electronic hydraulic pressure control apparatus 220 determines whether or not the user desires to perform a load beating operation through a manipulation state of the joystick, and varies and selects the preset behavior of the construction machine according to an operation situation based on the determination, increasing a convenience for a user and optimizing an operation efficiency.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. The scope of the present disclosure shall be construed by the following claims, and all technologies within a range equivalent to the scope of the present disclosure shall fall within the scope of the present disclosure.

The present disclosure can be used to enhance both comfortableness of an operator and an abrupt operation efficiency in manipulating a construction machine, resulting in provision of a convenience for an operator.

Although the present disclosure has been described with reference to exemplary and preferred embodiments, workers skilled in the art will recognize that changes may be made in form and detail without departing from the spirit and scope of the disclosure.

The invention claimed is:

1. An electronic hydraulic pressure control apparatus using a variable behavior, comprising:

a signal input unit configured to receive a manipulation signal according to a manipulation of a user;

a manipulation state determining unit configured to analyze the received manipulation signal and determine any one of a general behavior mode and an abrupt operation behavior mode to output a mode selection signal;

a behavior mode changing unit configured to change a behavior mode to the general behavior mode or the abrupt operation behavior mode according to the output mode selection signal;

a signal processing unit configured to, according to the changed behavior mode, output the received manipulation signal in the abrupt operation behavior mode, and increase or decrease the received manipulation signal by a predetermined gain and output the increased or decreased manipulation signal in the general behavior mode; and a proportional valve driving unit configured to drive a proportional valve according to a signal output by the signal processing unit, wherein the manipulation state determining unit determines the behavior mode to be the abrupt operation behavior mode if the received manipulation signal is alternately repeated to positive and negative positions with respect to a neutral position by a predetermined number within a predetermined time period, and determines the behavior mode to be the general behavior mode if the received manipulation signal is continuously maintained in any one of a neutral position, a positive position and a negative position for a predetermined time period.

2. An electronic hydraulic pressure control method using a variable behavior, comprising:

receiving a manipulation signal according to a manipulation of a user;

analyzing the received manipulation signal and determining any one of a general behavior mode and an abrupt operation behavior mode to output a mode selection signal;

changing a behavior mode to the general behavior mode or the abrupt operation behavior mode according to the received mode selection signal;

according to the changed behavior mode, outputting the received manipulation signal in the abrupt operation behavior mode, and increasing or decreasing the received manipulation signal by a predetermined gain and outputting the increased or decreased manipulation signal in the general behavior mode; and driving a proportional valve according to the output signal, wherein in the determining of the manipulation state, the behavior mode is determined to be the abrupt operation behavior mode if the received manipulation signal is alternately repeated to positive and negative positions with respect to a neutral position by a predetermined number within a predetermined time period, and the behavior mode is determined to be the general behavior mode if the received manipulation signal is continuously maintained in any one of a neutral position, a positive position and a negative position for a predetermined time period.

* * * * *